US009648994B2

(12) United States Patent
Cattacin et al.

(10) Patent No.: US 9,648,994 B2
(45) Date of Patent: May 16, 2017

(54) DISPENSER ASSEMBLY

(75) Inventors: Gilles Cattacin, Colmar (FR); Julien Marietta-Tondin, Marckholsheim (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 325 days.

(21) Appl. No.: 14/131,233

(22) PCT Filed: Jul. 6, 2012

(86) PCT No.: PCT/IB2012/001327

§ 371 (c)(1),
(2), (4) Date: Feb. 3, 2014

(87) PCT Pub. No.: WO2013/008071

PCT Pub. Date: Jan. 17, 2013

(65) Prior Publication Data

US 2014/0158810 A1 Jun. 12, 2014

(30) Foreign Application Priority Data

Jul. 8, 2011 (EP) ..... 11005581

(51) Int. Cl.

| | |
|---|---|
| ***A47K 10/38*** | (2006.01) |
| ***B65H 75/18*** | (2006.01) |
| ***B65H 16/00*** | (2006.01) |

(52) U.S. Cl.

CPC ..... *A47K 10/3827* (2013.01); *A47K 10/38* (2013.01); *B65H 16/005* (2013.01);
(Continued)

(58) Field of Classification Search

CPC ..... B65H 75/185; B65H 16/005; B65H 2401/213; B65H 2701/1924; A47K 10/38;
(Continued)

(56) References Cited

U.S. PATENT DOCUMENTS 1,577,451 A * 3/1926 Delerue ..... B65H 54/54 242/596.4
1,625,190 A * 4/1927 Boynton ..... A47K 10/22 24/522

(Continued)

FOREIGN PATENT DOCUMENTS

CN 101184421 5/2008
DE 2427519 A1 12/1975

(Continued)

OTHER PUBLICATIONS

Chinese Decision on Grant dated May 25, 2016 along with its English-language translation issued in related Chinese patent application No. 201280034079.9 (8 pages).

(Continued)

*Primary Examiner* — Emmanuel M Marcelo
*Assistant Examiner* — Michael Gallion
(74) *Attorney, Agent, or Firm* — Drinker Biddle & Reath LLP

(57) ABSTRACT

A dispenser assembly for dispensing a sheet from a roll of sheet material, which defines a cavity extending longitudinally, includes: a roll holder for removably holding the roll of sheet material being free to rotate relative to the roll holder; a base for supporting the roll holder and for coupling the dispenser assembly with an environment structure; and a pair of coupling elements including a first element coupled to the roll of sheet material and a second element integral to the roll holder. The first element is coupled in a free to rotate and removable manner relative to the second element by magnetic coupling. The first element includes a longitudinally extending engaging portion which is arranged to at least partially engage with an end portion of the cavity of the roll of sheet material so that the first element is fixedly secured to the roll of sheet material.

22 Claims, 5 Drawing Sheets

(52) U.S. Cl.
CPC ..... *B65H 75/185* (2013.01); *B65H 2401/213* (2013.01); *B65H 2701/1924* (2013.01)

(58) Field of Classification Search
CPC . A47K 10/3827; A47K 10/3836; A47K 10/40
See application file for complete search history.

(56) References Cited

U.S. PATENT DOCUMENTS 2,555,885 A * 6/1951 Hope ..... A47K 10/40 242/596.4
3,022,957 A * 2/1962 Blunt ..... A47K 10/38 211/101
4,381,083 A * 4/1983 Tsunetsugu ..... A47K 10/38 242/422.5
4,452,403 A * 6/1984 Arronte ..... A47K 10/40 242/596.4
4,614,312 A * 9/1986 Del Pino ..... A47K 10/40 242/559
4,676,448 A * 6/1987 Kofler ..... B65H 16/06 242/129.6
4,848,690 A * 7/1989 Lemoine ..... A47K 10/38 225/51
5,249,755 A * 10/1993 Jespersen ..... A47K 10/38 242/422.4
5,370,339 A * 12/1994 Moody ..... A47K 10/3836 242/573.9
5,449,127 A * 9/1995 Davis ..... A47K 10/38 242/560
5,992,459 A 11/1999 Sugita et al.
6,007,019 A * 12/1999 Lynch ..... A47K 10/3836 242/598.2
6,145,771 A * 11/2000 Santa Cruz ..... A47K 10/38 225/106
6,186,439 B1 * 2/2001 Carey ..... A47K 10/38 242/596.3
6,361,229 B1 * 3/2002 Shinga ..... B65H 75/08 160/323.1
7,287,720 B1 * 10/2007 Allegre ..... A47K 10/38 206/409
7,568,653 B2 * 8/2009 Zeiron ..... A47K 10/38 242/596.7
2003/0106398 A1 6/2003 Tramontina et al.
2006/0261211 A1 * 11/2006 Hass ..... A47K 10/405 242/598.1
2012/0280078 A1 * 11/2012 Lowe ..... A47K 10/38 242/597.1
2013/0047554 A1 * 2/2013 Bertram ..... B65H 23/182 53/452
2013/0112802 A1 * 5/2013 Griggs ..... A47J 47/16 242/590
2014/0158810 A1 6/2014 Cattacin et al.
2014/0158811 A1 6/2014 Cattacin et al.
2014/0266553 A1 * 9/2014 Chen ..... B65H 75/185 336/208

FOREIGN PATENT DOCUMENTS

DE 3114869 A1 10/1982
EP 1454579 A1 9/2004
EP 1600089 A1 11/2005
FR 2847790 A1 6/2004
JP H07250782 A 10/1995

OTHER PUBLICATIONS

English-language translation of a Chinese Office Action dated Aug. 24, 2015 issued in related Chinese patent application No. 201280034080.1 (8 pages).
English-language translation of a Chinese Office Action dated Aug. 12, 2015 issued in corresponding Chinese patent application No. 201280034079.9 (10 pages).

* cited by examiner

DISPENSER ASSEMBLY

CROSS-REFERENCE TO PRIOR APPLICATION

This application is a §371 National Stage Application of PCT International Application No. PCT/IB2012/001327 filed on Jul. 6, 2012, which claims priority to European Patent Application No. 11005581.1 filed on Jul. 8, 2011, both of which are incorporated herein in their entirety.

TECHNICAL FIELD

An aspect of the disclosure relates to a dispenser assembly. The disclosure further relates to a roll of sheet material adapted to be dispensed by the dispenser assembly. Such a dispenser assembly finds a particular, though non-exclusive, application in dispensing paper towel roll.

BACKGROUND

The document U.S. Pat. No. 5,449,127 describes a dispenser for rolls of sheet material including a base or housing for supporting one or more rolls of sheet material. An extension from one side of the housing includes a receiver for receiving one end of an axle/push rod. A journal is positioned on the opposite side of the housing from the receiver. The journal and receiver in turn are positioned along an axis. The axle/push rod has a first section which can be inserted into the center passageway through the roll and extend at least slightly out of the opposite side of the roll. A second section of the axle/push rod abutting the side of the roll has a diameter greater than the passageway through the roll and allows the axle/push rod to push the roll rotatably supported on the first section out of the housing. The entire length of the axle/push rod is greater than twice the length of a roll. The roll on the axle/push rod is then exposed outside the housing for dispensing of sheet material. Once the roll exposed for dispensing is expired, the axle is withdrawn from the receiver and withdrawn through the housing, with a half turn the remaining rolls drop in the housing and the axle right side up is reinserted into the next succeeding roll passageway. The axle/push rod is used to then push the next roll out to where it is positioned for dispensing.

The document U.S. Pat. No. 6,145,771 describes a dispenser for dispensing a paper or plastic product that allows a user to easily tear off one sheet of the product at a time. The dispenser includes a first magnetized member, a second magnetized member, a support bar and at least one stop device.

However, these techniques are not satisfactory because the loading operation may not be easily and/or quickly done.

SUMMARY

It is desired to have a dispenser assembly that overcomes the above mentioned drawbacks, and in particular improve the ease of loading operation.

According to one aspect, there is provided a dispenser assembly for dispensing a sheet from a roll of sheet material, the roll of sheet material defining a cavity extending longitudinally, the dispenser assembly including:

- a roll holder for removably holding the roll of sheet material, the roll of sheet material being free to rotate relatively to the roll holder;
- a base for supporting the roll holder and for coupling the dispenser assembly with an environment structure; and

- a pair of coupling elements including a first element coupled to the roll of sheet material and a second element integral to the roll holder, the first element being coupled in a free to rotate and removable manner relative to the second element by magnetic coupling.

The first element includes a longitudinally extending engaging portion, which is arranged to at least partially engage with an end portion of the cavity of the roll of sheet material so that the first element is fixedly secured to the roll of sheet material.

The first element may include a contacting portion arranged to transversely protrude the cavity and to at least partially cover an edge of the roll of sheet material.

The first element may be in the form of a plug, or in the form of a tack.

The engaging portion may include a fragile area for causing the first element to break in at least two parts as a result of at least one of the following actions: engagement into the cavity or at extraction from the cavity.

The second element may be a flange secured to the base through an arm, the second element including another contacting portion arranged for magnetic coupling to the contacting portion of the first element.

The roll holder may further include a resilient element for pressing the flange against the contacting portion of the first element.

The first element and the second element each may include a magnet, these magnets being oriented so as to provide an attractive magnetic force between the first element and the second element.

One of the pair of coupling elements may be made of a magnetic material, the other coupling element being made of a ferro-magnetic material.

One of the pair of coupling elements may be made of a plastic charged with a magnetic powder, the other coupling element being made of a plastic charged with a ferromagnetic powder.

One of the pair of coupling elements may include a magnet, the other coupling element including a piece of ferro-magnetic material.

The first element may be coupled to the second element through a punctual contact.

The contacting portion of one of the pair of coupling elements may have a surface selected from the group including an elliptical surface and a spherical surface, and the contacting portion of the other coupling element may have a surface selected from the group including an elliptical surface, a spherical surface and a planar surface.

The first element may be coupled to the second element through a surface contact, each element having a contacting portion in the form of a planar surface.

The pair of coupling elements may form a male/female assembly, the contacting portion of the first element being complementary with the contacting portion of the second element.

The contacting portion of one of the pair of coupling elements may be a tip whereby the contacting portion of this coupling element may have a shape selected from the group including an elliptical shape, a spherical shape, a conical shape and a cylindrical shape, and wherein the contacting portion of the other element may be a recess having a complementary shape arranged to receive the tip.

The second element may include means for generating a magnetic field acting on the magnetic material of the first element for generating a resistance against the free rotation of the first element relatively to the second element.

The dispenser assembly may include a pair of coupling elements positioned at both end portion of the cavity of the roll of sheet material.

The roll of sheet material may be wound onto a hollow or solid core.

The roll of sheet material may be a paper towel roll.

According to a another aspect, there is provided a roll of sheet material defining a cavity extending longitudinally, the roll of sheet material being provided with a coupling element including a longitudinally extending engaging portion, which is arranged to at least partially engage with the cavity of the roll of sheet material so that the coupling element is fixedly secured to the roll of sheet material, the roll of sheet material being adapted to be dispensed by the dispenser assembly.

According to a further aspect, there is provided a coupling element for coupling to a roll of sheet material, the roll of sheet material defining a cavity extending longitudinally, wherein the coupling element includes a longitudinally extending engaging portion, which is arranged to at least partially engage with the cavity of the roll of sheet material so that the coupling element is fixedly secured to the roll of sheet material, the coupling element being adapted to be coupled in a free to rotate and removable manner relative to another element by magnetic coupling in the dispenser assembly.

The disclosed embodiments enable easy and quick authorized stuffing and loading operations. This is particularly advantageous during maintenance of dispenser assembly used in a commercial application context.

Further, disclosed embodiments prevent unauthorized stuffing action of the dispenser assembly by an unauthorized provider or operator by requiring a specific coupling mechanism between the roll holder and the roll of sheet material. Further, the element associated with the roll of sheet material is arranged to at least partially break once having been firstly used avoiding a second use in association with another roll of sheet material. It enables the client of such dispenser assembly to have a specific, qualitative and controlled service during the maintenance operations.

Furthermore, an old dispenser assembly may be easily and economically retrofitted with the mechanism provided by disclosed embodiments merely by replacing the old arms with new arms supporting one of the magnetic coupling elements as described in the various embodiments provided in the following description.

Other advantages will become apparent from the hereinafter description of embodiments of the invention.

BRIEF DESCRIPTION OF THE DRAWINGS

Embodiments of the present invention are illustrated by way of examples and not limited to the accompanying drawings, in which like references indicate similar elements.

DETAILED DESCRIPTION OF PREFERRED EMBODIMENTS

In the following description, the terminology "a roll of sheet material" has a large meaning encompassing, as examples, the rolls of paper towels, toilet tissues, plastic sheets or the like, metal sheets (e.g. aluminum) sheets or the like, food preservation bags, wraps, etc. . . . . The sheet material may be rolled as a continuous non-perforated sheet or pre-perforated sheets. Further, the terminology "roll of sheet material" also covers either a roll of sheet material having a core, or a roll of sheet material being coreless. In particular, during the manufacturing process of the roll of sheet material, either the sheet material is wound into a cylinder onto a core (as an example a hollow cylinder made of cardboard, or a plastic mandrel, or a metallic axle, etc. . . . ), or the sheet material is wound into a cylinder on itself such as to define a central hollow cavity of substantially cylindrical shape and of variable size extending longitudinally.

The dispenser assembly may be used for residential or commercial applications for dispensing multiples of the hereinbefore mentioned sheets of material from a roll of sheet material.

The dispenser assembly may dispense the sheets of material from the roll of sheet material either manually (a user may pull the sheet of material with a hand) or motor assisted (a motor may assist in automatically dispensing the sheet of material on wish). There are numerous mechanisms to automatically dispense the sheet of material, and also to cut the sheet of material at the user requested length. These mechanisms are not specifically germane to the description of the present invention and will not be further described in details.

Figure 1:
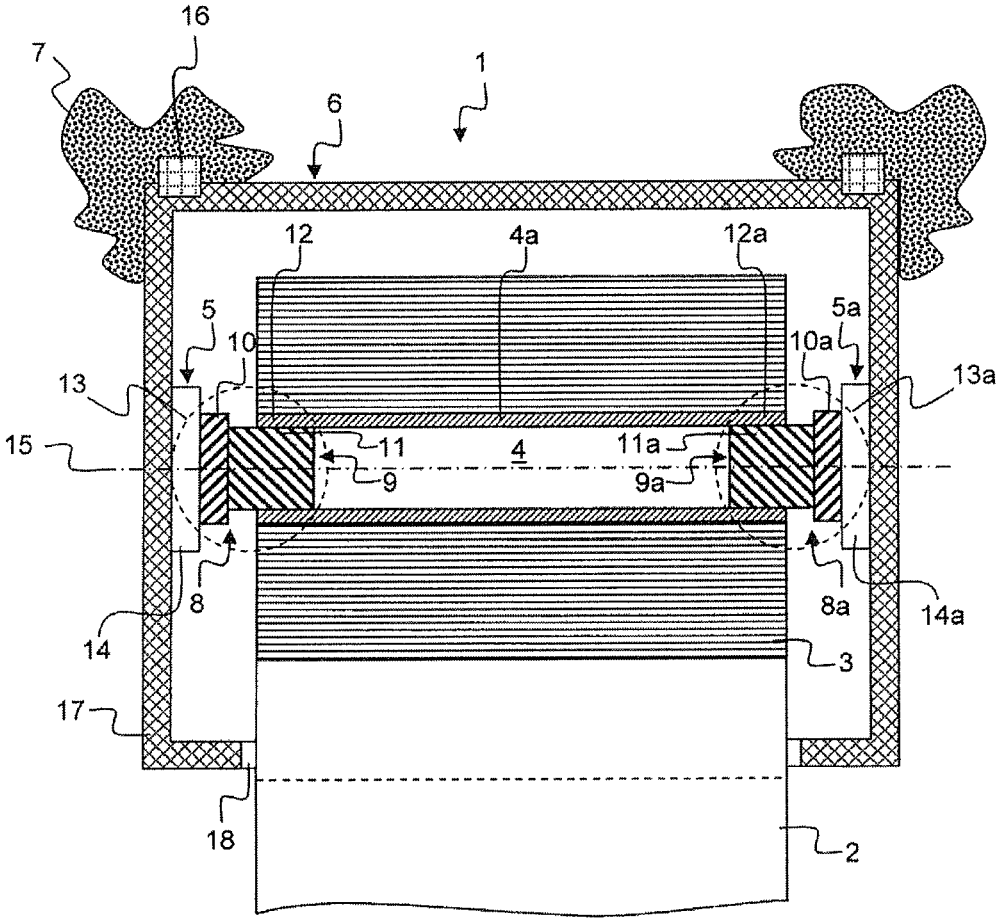
FIG. 1 is a front sectional view schematically illustrating an embodiment of a dispenser assembly.
Figure 10:
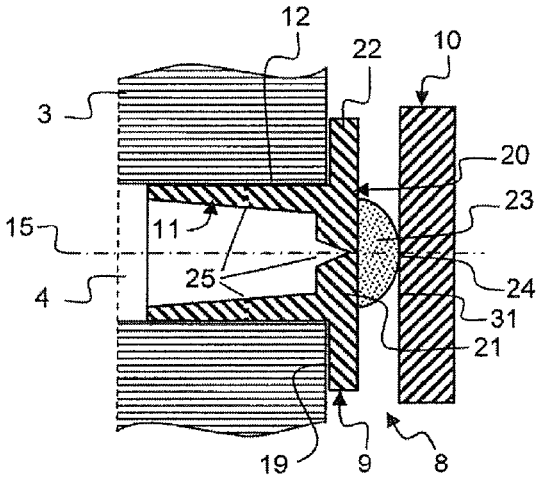
FIGS. 10 and 11 are sectional cut-away views taken of the interface zone 13/13*a* of FIG. 1 schematically illustrating various embodiments of a pair of coupling elements of a dispenser assembly applicable to coreless rolls of sheet material.
Figure 11:
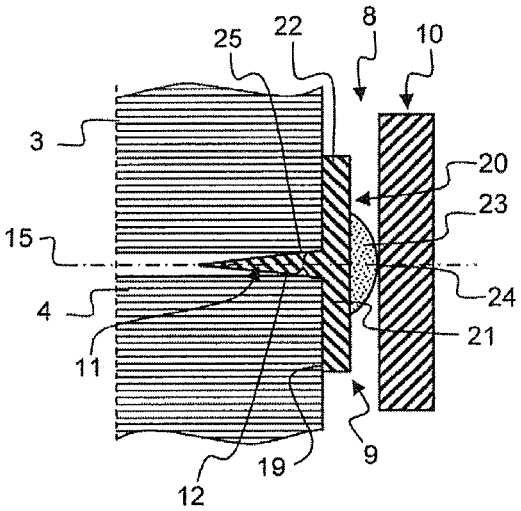

FIG. 1 schematically illustrates an embodiment of a dispenser assembly 1. In this embodiment the dispenser assembly 1 is used to dispense a sheet 2 from a roll of sheet material 3. The roll of sheet material 3 defines a cavity 4 extending longitudinally of longitudinal axis of revolution 15. This cavity is a central hollow cylinder. In this particular example, the roll of sheet material 3 is wound onto a core 4*a*, namely a hollow cylinder made of cardboard. As depicted in FIGS. 10 and 11, the roll of sheet material 3 may alternatively be a coreless roll of sheet material. In this case, the cavity may not be finely and equally defined all along the roll length as it lacks the supporting effect of the core 4*a*. The size of the cavity, in particular the diameter of the cavity depends on the manufacturing process. It is generally adapted to the dispenser assembly as explained hereinafter.

The dispenser assembly 1 includes a roll holder 5, 5*a*, a base 6, and a pair of coupling elements 8, 8*a*. In the embodiment depicted in FIG. 1, the dispenser assembly 1 includes two roll holders 5 and 5*a* and two pairs of coupling elements 8 and 8*a*, one on each end of the roll of sheet material 3.

The roll holder 5, 5*a* holds in a removable manner the roll of sheet material 3. The roll of sheet material 3 is free to rotate relative to the roll holder 5, 5*a*.

The base 6 supports the roll holder 5, 5*a*. The base 6 further couples the dispenser assembly 1 with an environment structure 7, for example a wall, by means of appropriate securing elements 16 (screw, glue, etc. . . . ). The base 6 may further include a housing 17 having a slit 18 that is adapted to dispense sheets 2 of material. The housing may include a hood (not shown) closed during the use of the dispenser assembly, and opened during loading or unloading operation of roll of sheet material into the dispenser assembly.

The pair of coupling elements 8, 8*a* includes a first element 9, 9*a* coupled to the roll of sheet material 3 and a second element 10, 10*a* integral to the roll holder 5, 5*a*. The first element 9, 9*a* is coupled to the second element 10, 10*a* by a magnetic coupling in an interface zone 13, 13*a*. The magnetic coupling is such that:

- the first element 9, 9*a* is free to rotate relative to the second element 10, 10*a* enabling free-rolling of the roll of sheet material 3 relative to the roll holder 5, 5*a*; and
- the first element 9, 9*a* is removable relative to the second element 10, 10*a* enabling engagement or disengagement of the roll of sheet material 3 with regards to the roll holder 5, 5*a*.

The first element 9, 9*a* includes a longitudinally extending engaging portion 11, 11*a*. The engaging portion 11, 11*a* is arranged to at least partially engage with an end portion 12, 12*a* of the cavity 4 of the roll of sheet material 3 so that the first element 9, 9*a* is fixedly secured to the roll of sheet material 3.

The second element 10, 10*a* may be a flange secured to the base 6 through for example an arm 14, 14*a*.

FIGS. 2 to 11 show the interface zone 13/13*a* of FIG. 1, schematically illustrating various embodiments of the pair of coupling elements 8. These embodiments are well suited to a dispenser assembly 1 dispensing sheets 2 from a roll of sheet material 3 wound around a core 4*a* as depicted in FIGS. 2 to 9. Similarly, all these embodiments are also well suited to a dispenser assembly 1 dispensing sheets 2 from a coreless roll of sheet material 3, namely a roll of sheet material 3 lacking the core 4. FIGS. 10 and 11 show only two examples of such embodiments applied to coreless roll of sheet material. Only the pair of coupling elements referenced 8 on one end of the roll of sheet material 3 is illustrated on these FIGS. 2 to 11. The other pair of coupling elements referenced 8*a* on the other end of the roll of sheet material 3 is symmetrical and will not be further illustrated and described.

FIGS. 2 to 7 schematically illustrate various embodiments of a pair of coupling elements wherein the first element 9 is in the form of a plug.

The plug includes the engaging portion 11 and the contacting portion 20.

The engaging portion 11 extends longitudinally. The engaging portion 11 is at least partially engaged with the end portion 12 of the cavity 4 of the roll of sheet material 3. The engaging portion 11 has circular revolution symmetry. It may be realized under the form of a hollow cylinder which size is such that the external wall of the engaging portion is substantially contacting the inner wall of the cavity 4. This enables a satisfactory mechanical support of the roll of sheet material 3 by the first element 9, in particular avoiding a loose fit between the first element 9 and the roll of sheet material.

Figure 2:
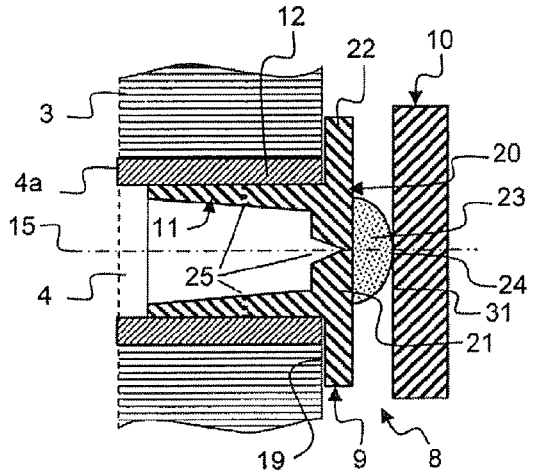
FIGS. 2 to 9 are sectional cut-away views taken of the interface zone 13/13*a* of FIG. 1 schematically illustrating various embodiments of a pair of coupling elements of a dispenser assembly applicable to rolls of sheet material having a core.

In the embodiment of FIG. 2, the contacting portion 20 extends transversely relatively to the engaging portion 11. The contacting portion 20 includes a central part 21 and a side part 22. The side part 22 of the contacting portion 20 protrudes the cavity 4 and covers at least partially an edge 19 of the roll of sheet material 3. The side part 22 may be realized under the form of ring. The side part 22 forms an abutment when inserting the plug into the cavity 4. As an example, the engaging portion 11 and the contacting portion 20 may be molded as a single piece made of plastic material. The central part 21 supports a magnet or a piece of ferro-magnetic material 23 having a contacting surface 24 being an elliptical surface or a spherical surface. The second element 10 has a contacting part 31 forming a plane. Thus, the first element 9 is coupled to the second element 10 through a punctual contact. This feature enables limiting the friction effect between this two elements providing a rotation of the roll of sheet material 3 relatively to the roll holder 5 even if a low pull force is exercised on the dispensed sheet 2 (shown in FIG. 1).

The magnet or the piece of ferro-magnetic material 23 is positioned facing the second element 10 (the flange). When the first element 9 includes a magnet, the second element 10 may include a magnet, these magnets being properly oriented to attract each other. Alternatively, the second element 10 may be made of a ferro-magnetic material. When the first element 9 includes a piece of ferro-magnetic material, the second element 10 may either include a magnet, or be made of magnetic material. In all these cases, an attractive magnetic force is provided for coupling the first element 9 to the second element 10.

Figure 3:
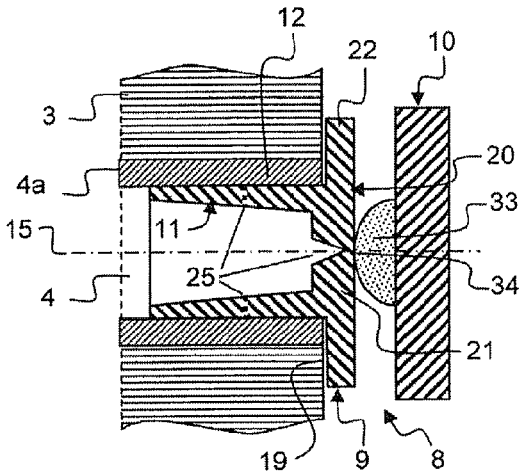

FIG. 3 shows an alternative embodiment which is based on the embodiment depicted in FIG. 2. This embodiment differs in that the contacting part 31 of the second element 10 supports the magnet or the piece of ferro-magnetic material 33 having a contacting surface 34 being an elliptical surface or a spherical surface. The contacting portion 20, in particular the central part 21, forms a plane.

Figure 4:
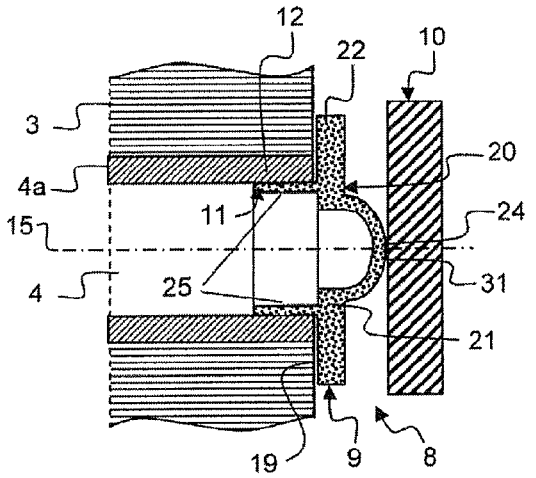
Figure 5:
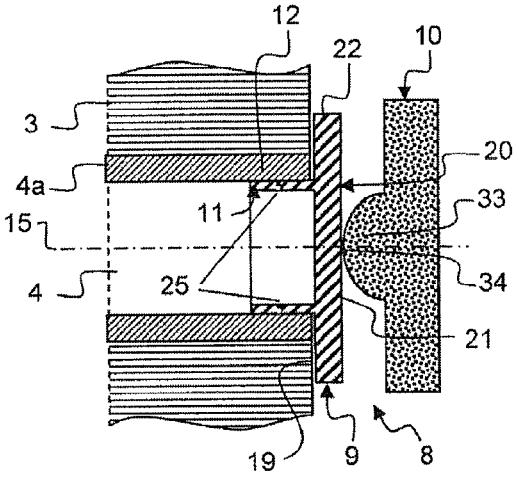

FIG. 4 and FIG. 5 show alternative embodiments which are based on the embodiments depicted in FIG. 2 and FIG. 3, respectively. These embodiments differ in that one of the pair of coupling elements is made of a plastic charged with a magnetic powder, the other coupling element being made of a plastic charged with a ferromagnetic powder.

Figure 6:
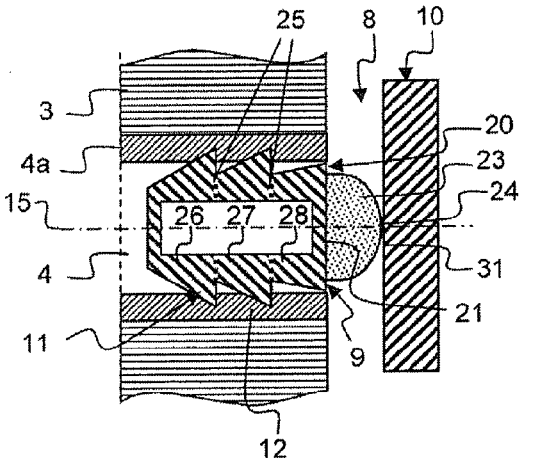

In the embodiment of FIG. 6, the engaging portion 11 may be realized under the form of a succession of truncated-cone-shaped sections for example three sections 26, 27 and 28. It may have a hollow core. The succession of truncated-cone-shaped sections 26, 27 and 28 extends longitudinally. The diameter of some of the truncated-cone-shaped sections may be greater than the diameter of the cavity 4. The plug may be inserted by applying an appropriate force such that the engaging portion 11 securely fits within the cavity 4 when the truncated-cone-shaped sections penetrates within the inner wall of the cavity (the roll of sheet material being either core or coreless). As an example, the whole engaging portion 11 may be molded as a single piece made of plastic material.

The contacting portion 20 is defined by the end part 21 of the last truncated-cone-shaped section 28.

As an alternative, though not shown, a side part of the contacting portion protruding the cavity and covering at least partially an edge of the roll of sheet material may be provided.

The end part 21 supports a magnet or a piece of ferro-magnetic material 23 having a contacting surface 24 being an elliptical surface or a spherical surface. The second element 10 has a contacting portion 31 forming a plane. The first element 9 is coupled to the second element 10 through a punctual contact. The magnet or the piece of ferro-magnetic material 23 is similar to the one in the embodiment of FIG. 2 and, thus, will not be further described.

Figure 7:
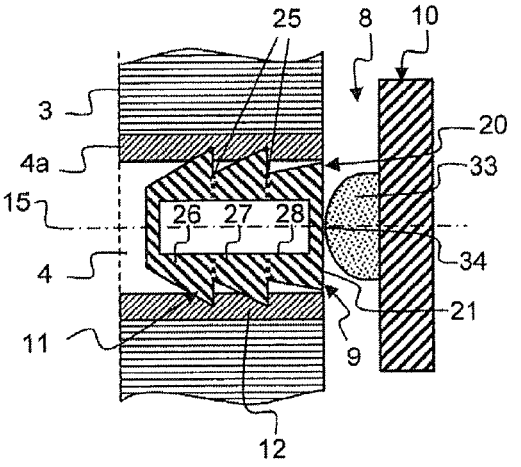

FIG. 7 shows an alternative embodiment which is based on the embodiment depicted in FIG. 6. This embodiment differs in that the second element 10 supports the magnet or the piece of ferro-magnetic material 33 having a contacting surface 34 being an elliptical surface or a spherical surface. The contacting portion 20, in particular the central part 21, forms a plane.

Figure 8:
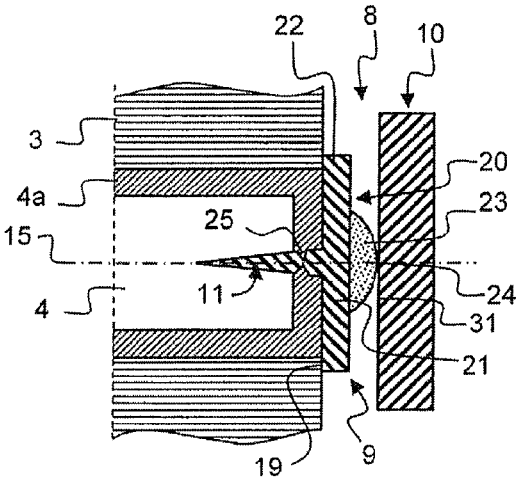
Figure 9:
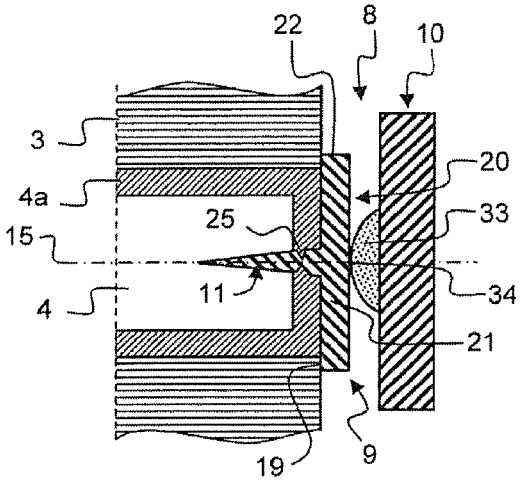

FIGS. 8 and 9 schematically illustrate two embodiments of a pair of coupling elements wherein the first element 9 is in the form of a tack.

The tack includes the engaging portion 11 and the contacting portion 20.

The engaging portion 11 is realized under the form of a pin extending longitudinally. The engaging portion 11 is at least partially engaged in the end portion 12 of the cavity 4 of the roll of sheet material 3. This embodiment is well adapted to either core 4*a* being closed at each end or solid core or core having a small inner diameter. The tack may be inserted by applying an appropriate force such that the engaging portion 11 pinched the end of the core and securely fits within the cavity 4. This enables a satisfactory mechanical support of the roll of sheet material 3 by the first element 9, in particular avoiding a loose fit between the first element 9 and the roll of sheet material.

The contacting portion 20 extends transversely relatively to the engaging portion 11. It forms the head of the tack. The contacting portion 20 includes a central part 21 and a side part 22. The side part 22 of the contacting portion 20 protrudes the cavity 4 and covers at least partially an edge 19 of the roll of sheet material 3. The side part 22 may be realized under the form of ring. The side part 22 forms an abutment when inserting the tack into the cavity 4. The central part 21 supports a magnet or a piece of ferro-magnetic material 23 having a contacting surface 24 being an elliptical surface or a spherical surface. The second element 10 has a contacting portion 31 forming a plane. The first element 9 is coupled to the second element 10 through a punctual contact. The magnet or the piece of ferro-magnetic material 23 is similar to the one in the embodiment of FIG. 2 and, thus, will not be further described.

As an example, the engaging portion 11 and the contacting portion 20 may be realized as a single piece.

FIG. 9 shows an alternative embodiment which is based on the embodiment depicted in FIG. 8. This embodiment differs in that the second element 10 supports the magnet or the piece of ferro-magnetic material 33 having a contacting surface 34 being an elliptical surface or a spherical surface. The contacting portion 20, in particular the central part 21, forms a plane.

FIGS. 10 and 11 show the interface zone 13/13*a* of FIG. 1, schematically illustrating various embodiments of the pair of coupling elements 8 applicable to coreless rolls of sheet material.

In a coreless roll of sheet material 3, the cavity 4 may not be finely and equally defined all along the roll length as it lacks the supporting effect of the core 4*a*.

FIG. 10 shows the embodiment of FIG. 2 wherein the first element 9 is in the form of a plug. During the manufacturing process of the roll of sheet material, the sheet material may be wound into a cylinder onto the plug positioned at each end. In this case, the size of the cavity 4, in particular the diameter of the cavity depends on the diameter of the engaging portion 11 of the plug.

FIG. 11 shows the embodiment of FIG. 8 wherein the first element 9 is in the form of a tack. During the manufacturing process of the roll of sheet material, the sheet material may be wound into a cylinder onto itself. Then, the tack may be pinched into each end of the roll of sheet material though the cavity 4. In this case, the size of the cavity 4, in particular the diameter of the cavity is the smallest possible diameter enabling to securely retain the pin once pinched. The tack is well adapted for coreless roll of sheet material because despite the fact that the cavity of the coreless roll of sheet material may be crumpled as it lacks the supporting features of the core, it is easy to pinch the tack into the cavity by applying the appropriate force.

In the hereinbefore described embodiments depicted in FIGS. 2 to 11, the engaging portion and/or the contacting portion may include at least one fragile area 25. The fragile area causes the first element 9 to break in at least two parts as a result of the engagement of the engaging portion 11 into the cavity 4. Alternatively, the fragile area causes the first element 9 to break in at least two parts as a result of the extraction from the cavity 4. Thus, a subsequent use of the first element 9 is prevented. A fragile area 25 may be realized in different ways, for example as pre-cuttings, grooves, lines of reduced thickness, a series of circumferentially disposed holes, a shearing material, a combination of anyone of the hereinbefore means, etc. . . . .

The magnetic coupling through a punctual contact as hereinbefore described in relation with the various embodiments enables reducing the friction between the two coupling elements, thus between the roll of sheet material and the roll holder. This enables reducing the force or energy required to dispense a sheet of material either manually or motor assisted. When the dispenser assembly includes a motor (not shown) to dispense the sheet of material, having a low friction enables either to reduce electrical consumption of the motor, or to downsize the motor power for the same dispenser assembly characteristics. Further, it also reduces the motor loudness during the dispensing operation. When the dispenser assembly is manually operated (i.e. without the help of a motor), the sheet of material may be dispensed in a quasi-automatic manner by combining a very low pull force exercised on the dispensed sheet with the low friction and the effect of gravity on the currently dispensed sheet of material.

In the embodiments illustrated in FIGS. 2 to 11, the first element 9 is coupled to the second element 10 through a punctual contact, either a contacting surface 24 being an elliptical surface or a spherical surface against a planar contacting portion 31 of the second element 10, or a planar contacting portion 20 against a contacting surface 34 being an elliptical surface or a spherical surface. The magnetic coupling between the first element 9 and the second element 10 may be implemented in other different ways. FIGS. 12 to 18 schematically illustrate other possible coupling arrangements. These coupling arrangements may replace the punctual contact in the embodiments illustrated in FIGS. 2 to 11. It should be appreciated by those skilled in the art that the coupling arrangements herein represent conceptual views of illustrative magnetic coupling arrangements that may be adapted in the dispenser assembly.

Figure 12:
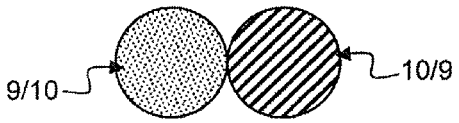
FIGS. 12 to 18 are sectional cut-away views taken of the interface zone 13/13*a* of FIG. 1 schematically illustrating various coupling arrangements for a dispenser assembly.

FIG. 12 illustrates an alternative to the punctual contact. The contacting portion of one of the pair of coupling elements (the first element 9 respectively the second element 10) has a surface that may be an elliptical surface or a spherical surface. The contacting portion of the other coupling element (the second element 10 respectively the first element 9) has a surface that may also be an elliptical surface or a spherical surface. The punctual contact enables minimizing the effect of friction between the first element 9 and the second element 10 as hereinbefore explained.

Figure 13:
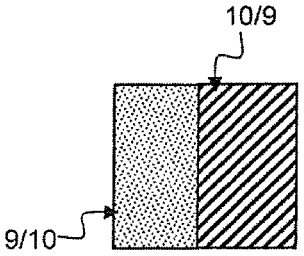
Figure 14:
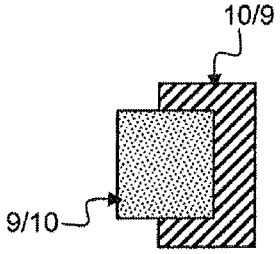
Figure 15:
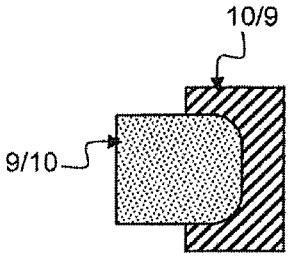
Figure 16:
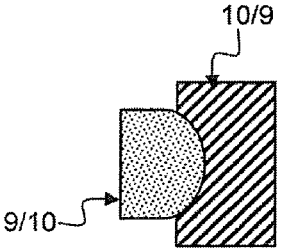
Figure 17:
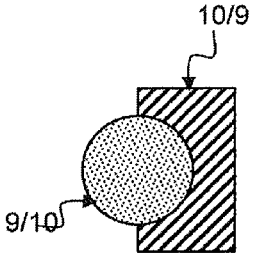
Figure 18:
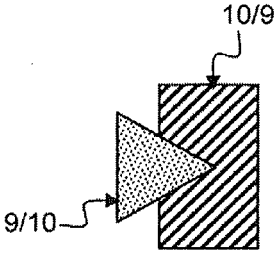

FIG. 13 illustrates a surface contact. Each of the first element 9 and the second element 10 has a contacting portion in the form of a planar surface.

FIGS. 14 to 18 illustrate various alternatives to a surface contact. The pair of coupling elements forms a male/female assembly. The contacting portion of the first element 9 is complementary with the contacting portion of the second element 10. The contacting portion of one of the pair of coupling elements (the first element 9 respectively the second element 10) is a tip like element having a shape that may be a cylindrical shape with either a right-angled edge (FIG. 14) or a rounded edge (FIG. 15), or an elliptical shape (FIG. 16), or a spherical shape (FIG. 17), or a conical shape. The contacting portion of the other coupling element (the second element 10 respectively the first element 9) is a recess like element having a complementary shape arranged to receive the tip, namely a cylindrical shape with either a right-angled edge or a rounded edge, or an elliptical shape, or a spherical shape, or a conical shape. These embodiments enable providing a further mechanical support to the magnetic coupling.

Figure 19:
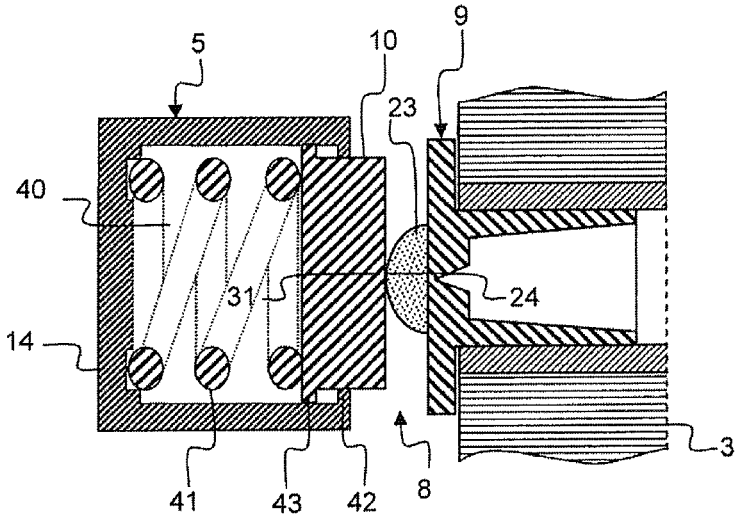
FIG. 19 is sectional cut-away view taken of the interface zone 13/13*a* of FIG. 1 schematically illustrating an example of roll holder in a dispenser assembly.

FIG. 19 schematically illustrates an example of roll holder 5 (or 5*a*). The second element 10 is a flange secured to an arm 14. The arm 14 may include a recess 40 receiving the second element 10 and also a resilient element, for example a spring 41. The second element 10 is free to move within the recess while being pushed by the spring 41 outside the recess. An abutment 42 in the recess may cooperate with a shoulder 43 of the second element 10 to block the full translation of the second element outside the recess 40. During a loading or unloading operation of the dispenser assembly 1, the second element 10 is retracted into the recess 10 due to the pushing action of the roll of sheet material 3 being installed. Once in place, the spring 41 presses the second element 10 against the contacting portion (e.g. the contacting surface 24 of the magnet or the piece of ferro-magnetic material 23) of the first element 9. This enables providing a satisfactory contact between the first and the second elements.

Figure 20:
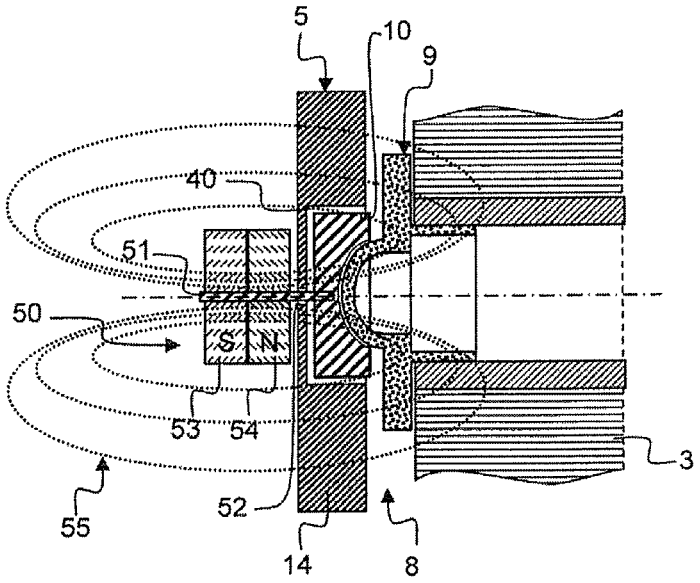
FIG. 20 is sectional cut-away view taken of the interface zone 13/13*a* of FIG. 1 schematically illustrating a coupling embodiment provided with a braking mechanism in a dispenser assembly.

FIG. 20 schematically illustrates a coupling embodiment provided with a braking mechanism 50.

The arm 14 of the roll holder 5 includes a recess 40 receiving the second element 10. The braking mechanism 50 includes an axle 51 passing through the end wall of the recess 40 via a hole 52. The axle is secured on one end to the second element 10 and to the other end to a means for generating a magnetic field 55 extending towards the first element 9. The magnetic field 55 acts on the magnetic material of the first element 9. This interaction results in the application of a resistance against the free rotation of the roll of sheet material 3. As an example, the means for generating a magnetic field 55 may be realized by securing a first magnet 53 and a second magnet 54 to the axle, both magnets having inversed polarity (N/S). This enables avoiding over-dispensing and wasting the sheets of material from the roll 3. Though, not shown, a combination of the braking mechanism 50 with the roll holder of FIG. 19 including a resilient element is possible.

The drawings and their descriptions hereinbefore illustrate rather than limit the invention.

The depicted embodiment of dispenser assembly in FIG. 1 illustrates a particular example of a base including a closed housing with a slit. However, other kind of base, for example providing an open access to the roll of sheet material may be convenient provided that the coupling between the roll holder and the roll of sheet material is of the magnetic coupling kind as described hereinbefore.

The depicted embodiments illustrate a dispenser assembly wherein the roll of sheet material is positioned horizontally. However, it may also be positioned vertically, or at an angle.

The depicted embodiment of dispenser assembly in FIG. 1 illustrates a particular example of a dispenser assembly where the roll of sheet material is held on each edge by two pairs of coupling elements. However, it may also be held on one edge by one pair of coupling element as hereinbefore described and on the other edge by any other appropriate holding mechanism.

Any reference sign in a claim should not be construed as limiting the claim. The word "comprising" does not exclude the presence of other elements than those listed in a claim. The word "a" or "an" preceding an element does not exclude the presence of a plurality of such element.

The invention claimed is:

1. A dispenser assembly for dispensing a sheet from a roll of sheet material, the roll of sheet material defining a cavity extending longitudinally, the dispenser assembly comprising:

a roll holder for removably holding the roll of sheet material, the roll of sheet material being free to rotate relative to the roll holder;

a base for supporting the roll holder and for coupling the dispenser assembly with an environment structure; and a pair of coupling elements comprising a first element coupled to the roll of sheet material and a second element integral to the roll holder, the first element being coupled in a free to rotate and removable manner relative to the second element by magnetic coupling;

wherein the first element comprises a longitudinally extending engaging portion, which is arranged within the cavity before loading the roll of sheet material on the roll holder to at least partially engage with an end portion of the cavity of the roll of sheet material so that the first element is fixedly secured to the roll of sheet material.

2. The dispenser assembly of claim 1, wherein the first element comprises a contacting portion arranged to transversely protrude the cavity and to at least partially cover an edge of the roll of sheet material.

3. The dispenser assembly of claim 1, wherein the first element is in the form of a plug.

4. The dispenser assembly of claim 1, wherein the first element is in the form of a tack.

5. The dispenser assembly according to claim 2, wherein the engaging portion comprises a fragile area for causing the first element to break in at least two parts as a result of at least one of the following actions: engagement into the cavity or at extraction from the cavity.

6. The dispenser assembly according to claim 1, wherein the second element is a flange secured to the base through an arm, the second element comprising a contacting portion arranged for magnetic coupling to a contacting portion of the first element.

7. The dispenser assembly of claim 6, wherein the roll holder further comprises a resilient element for pressing the flange against the contacting portion of the first element.

8. The dispenser assembly according to claim 1, wherein the first element and the second element each comprises a magnet, these magnets being oriented so as to provide an attractive magnetic force between the first element and the second element.

9. The dispenser assembly according to claim 1, wherein one of the pair of coupling elements is made of a magnetic material, the other coupling element being made of a ferromagnetic material.

10. The dispenser assembly according to claim 1, wherein one of the pair of coupling elements is made of a plastic charged with a magnetic powder, the other coupling element being made of a plastic charged with a ferromagnetic powder.

11. The dispenser assembly according to claim 1, wherein one of the pair of coupling elements comprises a magnet, the other coupling element comprising a piece of ferro-magnetic material.

12. The dispenser assembly according to claim 1, wherein the first element is coupled to the second element through a punctual contact.

13. The dispenser assembly according of claim 12, wherein a contacting portion of one of the pair of coupling elements has a surface selected from the group consisting of an elliptical surface and a spherical surface, and wherein a contacting portion of the other coupling element has a surface selected from the group consisting of an elliptical surface, a spherical surface and a planar surface.

14. The dispenser assembly according to claim 1, wherein the first element is coupled to the second element through a surface contact, each element having a contacting portion in the form of a planar surface.

15. The dispenser assembly according to claim 1, wherein the pair of coupling elements forms a male/female assembly, a contacting portion of the first element being complementary with a contacting portion of the second element.

16. The dispenser assembly according to claim 15, wherein the contacting portion of one of the pair of coupling elements is a tip whereby the contacting portion of this coupling element has a shape selected from the group consisting of an elliptical shape, a spherical shape, a conical shape and a cylindrical shape, and wherein the contacting portion of the other element is a recess having a complementary shape arranged to receive the tip.

17. The dispenser assembly according to claim 1, wherein the second element comprises a brake for generating a magnetic field acting on the magnetic material of the first element for generating a resistance against the free rotation of the first element relative to the second element.

18. The dispenser assembly according to claim 1, wherein the dispenser assembly further comprises a second pair of coupling elements positioned at an end portion of the cavity of the roll of sheet material opposed to the end portion to which the pair of coupling elements is positioned.

19. The dispenser assembly according to claim 1, wherein the roll of sheet material is wound onto a hollow or solid core.

20. The dispenser assembly according to claim 1, wherein the roll of sheet material is a paper towel roll.

21. A roll of sheet material defining a cavity extending longitudinally, the roll of sheet material being provided with a first coupling element comprising a longitudinally extending engaging portion, which is arranged to at least partially engage with the cavity of the roll of sheet material so that the first coupling element is fixedly secured to the roll of sheet material, the roll of sheet material being adapted to be dispensed by a dispenser assembly comprising:

a roll holder for removably holding the roll of sheet material, the roll of sheet material being free to rotate relative to the roll holder;

a base for supporting the roll holder and for coupling the dispenser assembly with an environment structure; and a second coupling element, which forms a pair of coupling elements with the first element, wherein the second element is integral to the roll holder and the first element is coupled in a free to rotate and removable manner relative to the second element by magnetic coupling;

wherein the first element comprises a longitudinally extending engaging portion, which is arranged within the cavity before loading the roll of sheet material on the roll holder to at least partially engage with an end portion of the cavity of the roll of sheet material so that the first element is fixedly secured to the roll of sheet material.

22. A coupling element for coupling to a roll of sheet material, the roll of sheet material defining a cavity extending longitudinally, wherein the coupling element comprises a longitudinally extending engaging portion, which is arranged to at least partially engage with the cavity of the roll of sheet material so that the coupling element is fixedly secured to the roll of sheet material, the coupling element being adapted to be coupled in a free to rotate and removable manner relative to another element by magnetic coupling in a dispenser assembly comprising:

a roll holder for removably holding the roll of sheet material, the roll of sheet material being free to rotate relative to the roll holder;

a base for supporting the roll holder and for coupling the dispenser assembly with an environment structure; and a pair of coupling elements comprising the coupling element coupled to the roll of sheet material and the another element integral to the roll holder, the coupling element being coupled in a free to rotate and removable manner relative to the another element by magnetic coupling;

wherein the coupling element comprises a longitudinally extending engaging portion, which is arranged within the cavity before loading the roll of sheet material on the roll holder to at least partially engage with an end portion of the cavity of the roll of sheet material so that the first element is fixedly secured to the roll of sheet material.

* * * * *